US012326052B2

(12) United States Patent
Doane et al.

(10) Patent No.: US 12,326,052 B2
(45) Date of Patent: Jun. 10, 2025

(54) SLIP SYSTEM, METHOD AND BOREHOLE SYSTEM

(71) Applicant: Baker Hughes Oilfield Operations LLC, Houston, TX (US)

(72) Inventors: James Doane, Friendswood, TX (US); Stephen Zamora, Pearland, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 14 days.

(21) Appl. No.: 18/304,461

(22) Filed: Apr. 21, 2023

(65) Prior Publication Data

US 2024/0352814 A1 Oct. 24, 2024

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01)

(58) Field of Classification Search
CPC ..... E21B 23/01; E21B 33/129
See application file for complete search history.

(56) References Cited

U.S. PATENT DOCUMENTS 4,711,326 A 12/1987 Baugh et al.
6,241,017 B1 * 6/2001 Doane ..... E21B 23/01 166/134
10,648,276 B2 * 5/2020 Anderson ..... E21B 33/129
2015/0021048 A1 * 1/2015 Ruffo ..... E21B 33/1291 166/117.6
2018/0023368 A1 1/2018 Anderson et al.
2018/0045017 A1 2/2018 Thornton et al.
2022/0275701 A1 9/2022 Anderson et al.

FOREIGN PATENT DOCUMENTS

WO 2019212686 A1 11/2019

OTHER PUBLICATIONS

Notification of Transmittal of the International Search Report and the Written Opinion of the International Searching Authority, or the Declaration; PCT/US2024/023991; Mail date: Jul. 25, 2024; 10 pages.

* cited by examiner

*Primary Examiner* — Nicole Coy
*Assistant Examiner* — Nicholas D Wlodarski
(74) *Attorney, Agent, or Firm* — Baker Hughes Patent Organization

(57) ABSTRACT

A timed-release slip system includes a plurality of slips each having a lateral tongue. The system further includes a cone having a track subsystem, the track subsystem configured to retain the plurality of slips during running and setting while allowing longitudinal motion of the slip in parallel to a longitudinal axis of the cone while being retrieved. Finally, the system includes a slip ring configured to pull one or more of the plurality of slips before a different one or more of the plurality of slips. A method for setting and releasing a slip system, includes driving a plurality of slips into a cone having a track subsystem configured to retain the plurality of slips during running and setting against a radially outwardly positioned structure, timing release of the plurality of slips, allowing longitudinal motion of the slips in parallel to a longitudinal axis of the cone while being released.

17 Claims, 10 Drawing Sheets

SLIP SYSTEM, METHOD AND BOREHOLE SYSTEM

BACKGROUND

Slip systems are common in the downhole industry. They are used to anchor many different tools needed to perform operations downhole. Some slip systems use track subsystems to improve radial slip travel for a given diameter of slip system. Other slip systems do not include track subsystems but have other advantages that are contraindicated in track subsystems such as timed-release configurations. While each type and others have advantages, they also have disadvantages that the art would prefer are eliminated.

SUMMARY

An embodiment of a timed-release slip system including a plurality of slips each having a lateral tongue, a cone having a track subsystem, the track subsystem configured to retain the plurality of slips during running and setting while allowing longitudinal motion of the slip in parallel to a longitudinal axis of the cone while being retrieved, a slip ring configured to pull one or more of the plurality of slips before a different one or more of the plurality of slips.

An embodiment of a method for setting and releasing a slip system, including driving a plurality of slips into a cone having a track subsystem configured to retain the plurality of slips during running and setting against a radially outwardly positioned structure, applying a tensile load to a first one or more of the plurality of slips while not applying tensile load to a second one or more of the plurality of slips, allowing longitudinal motion of the first one or more of the plurality of slips in parallel to a longitudinal axis of the cone while being released.

An embodiment of a downhole tool including a mandrel, a plurality of slips each having a lateral tongue disposed on the mandrel, a cone having a track subsystem disposed on the mandrel, the track subsystem configured to retain the plurality of slips during running and setting while allowing longitudinal motion of the slip in parallel to a longitudinal axis of the cone while being retrieved, a slip ring disposed on the mandrel and configured to apply tensile load to one or more of the plurality of slips before a different one or more of the plurality of slips.

An embodiment of a borehole system including a borehole in a subsurface formation, a string in the borehole, and a slip system, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
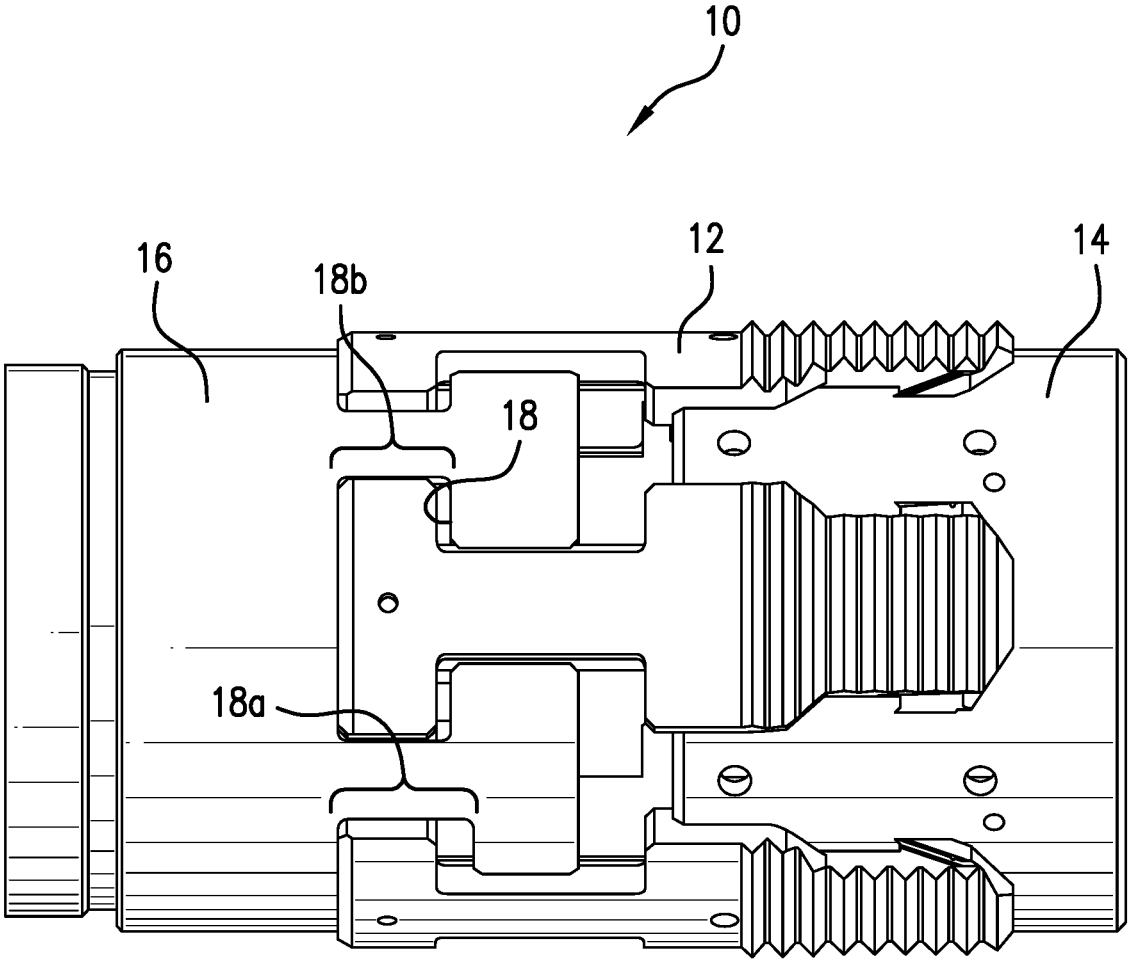
FIG. 1 is a side view of a slip system as disclosed herein.

Referring to FIG. 1, a slip system 10 is illustrated. The system 10 includes a plurality of slips 12, a cone 14 and a slip ring 16. It should be appreciated that slip ring 16 is a timed slip ring, meaning that each window 18 (such as window 18*a* vs window 18*b*, for example) has a different length in the longitudinal direction of the system 10 such that upon tensile loading of the ring 16 one or more of the plurality of slips 12 will be loaded to release the set slip system 10 before one or more others of the plurality of slips 12.

Figure 2:
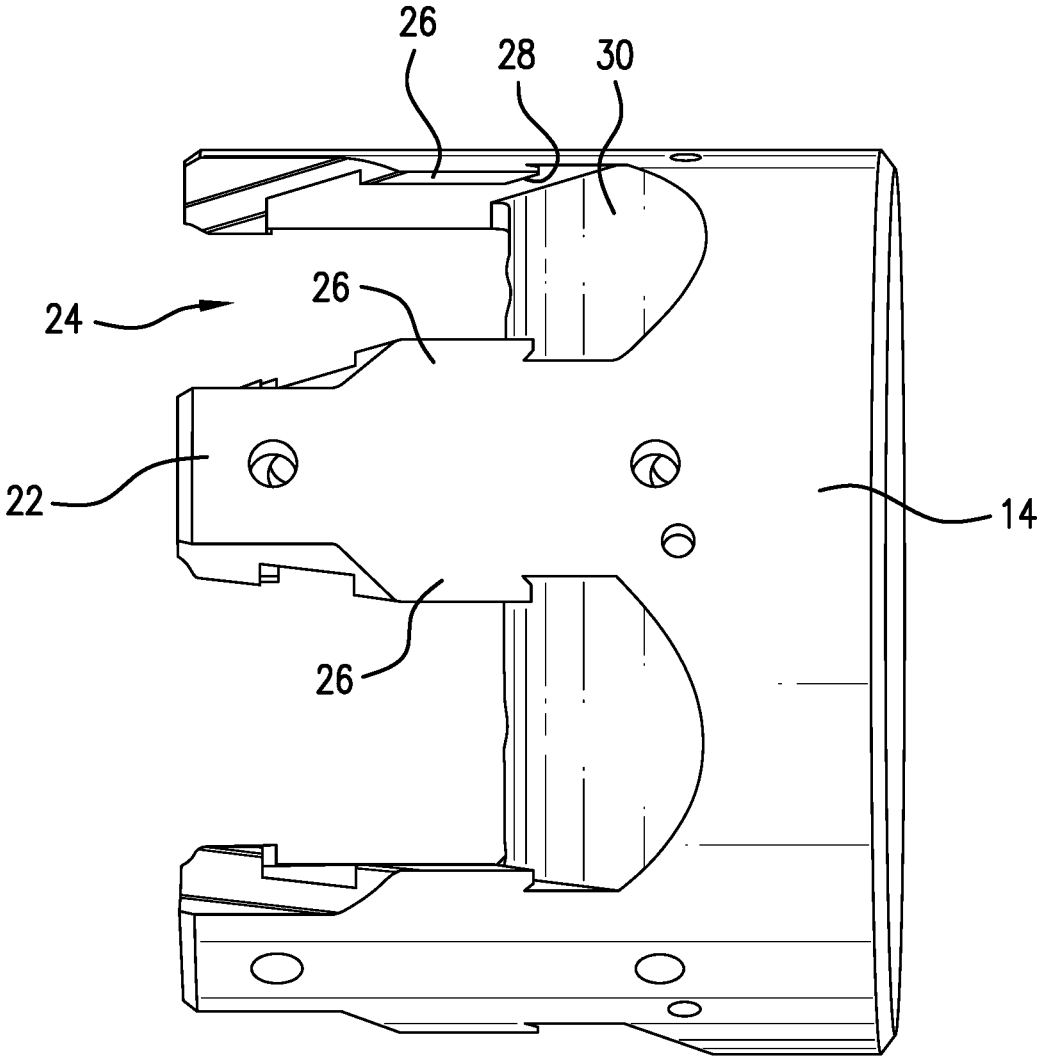
FIG. 2 is a side view of a cone of the system illustrated in FIG. 1.
Figure 3:
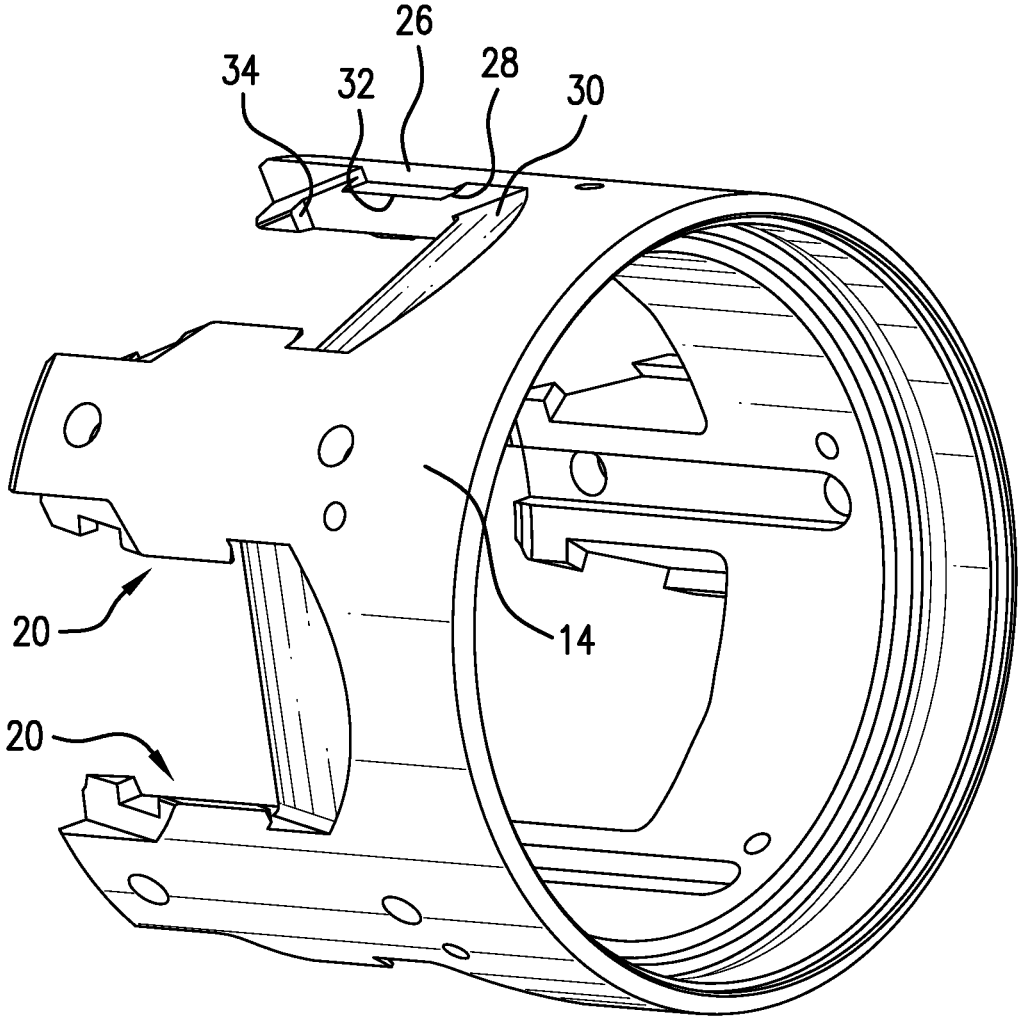
FIG. 3 is a perspective view of the cone illustrated in FIG. 2.

Referring to FIGS. 2 and 3, a side view and a perspective view of the cone 14 are illustrated, respectively, apart from the other components of the system 10. These drawings together provide insight into a track subsystem 20 of the system 10. The subsystem 20 comprises a plurality of slip separators 22 between adjacent ones of which are slip ways 24. The number of separators 22 is the same as the number of slips in the plurality of slips 12 that are desired. Each slip separator 22 includes a buttress 26 extending in a circumferential direction. As illustrated, a buttress 26 extends circumferentially from each circumferential side of each separator 22. It is, however, contemplated that not all separators have buttresses in some embodiments. Buttress 26 includes a track face 28 that is set spaced from and parallel to a cone face 30 of the cone 14. Buttress 26 also provides a decouple recess 32. In some embodiments the subsystem 20 includes a stop 34.

Figure 4:
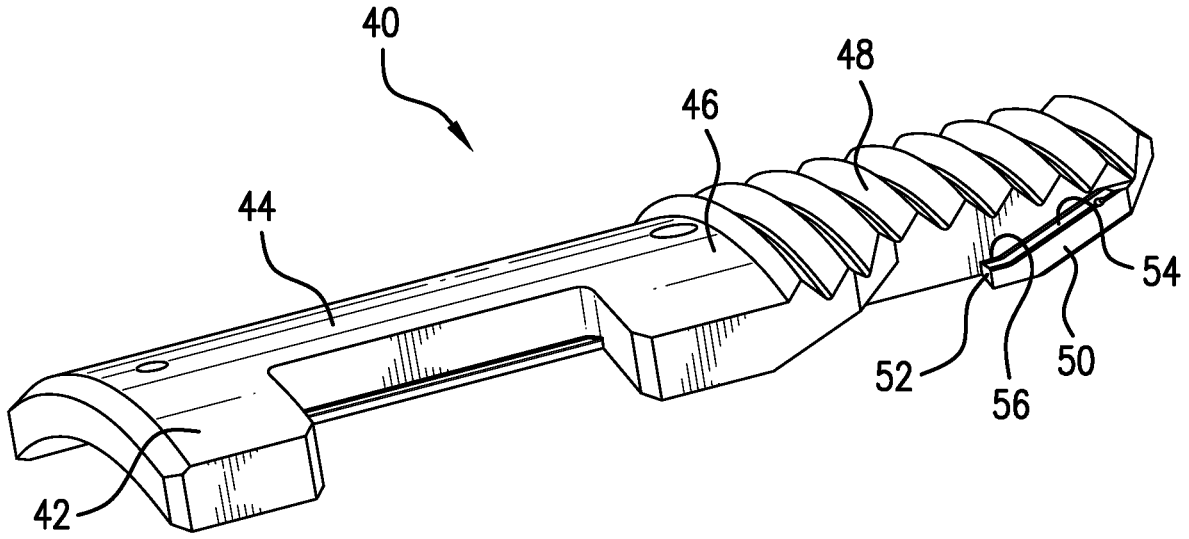
FIG. 4 is a perspective view of a slip of the system illustrated in FIG. 1.

Referring to FIG. 4 a slip 40 of the plurality of slips 12 is illustrated alone and in perspective view. The slip 40 comprises a slip tail 42, a slip body 44 and a slip head 46. Head 46 includes one or more wickers 48 and a lateral tongue 50. Lateral tongue 50 further includes a stop mating surface 52 and a retract surface 54. Also, the tongue 50 may in some embodiments include a catch surface 56 whose functions will be appreciated in connection with additional description hereinafter.

Figure 5:
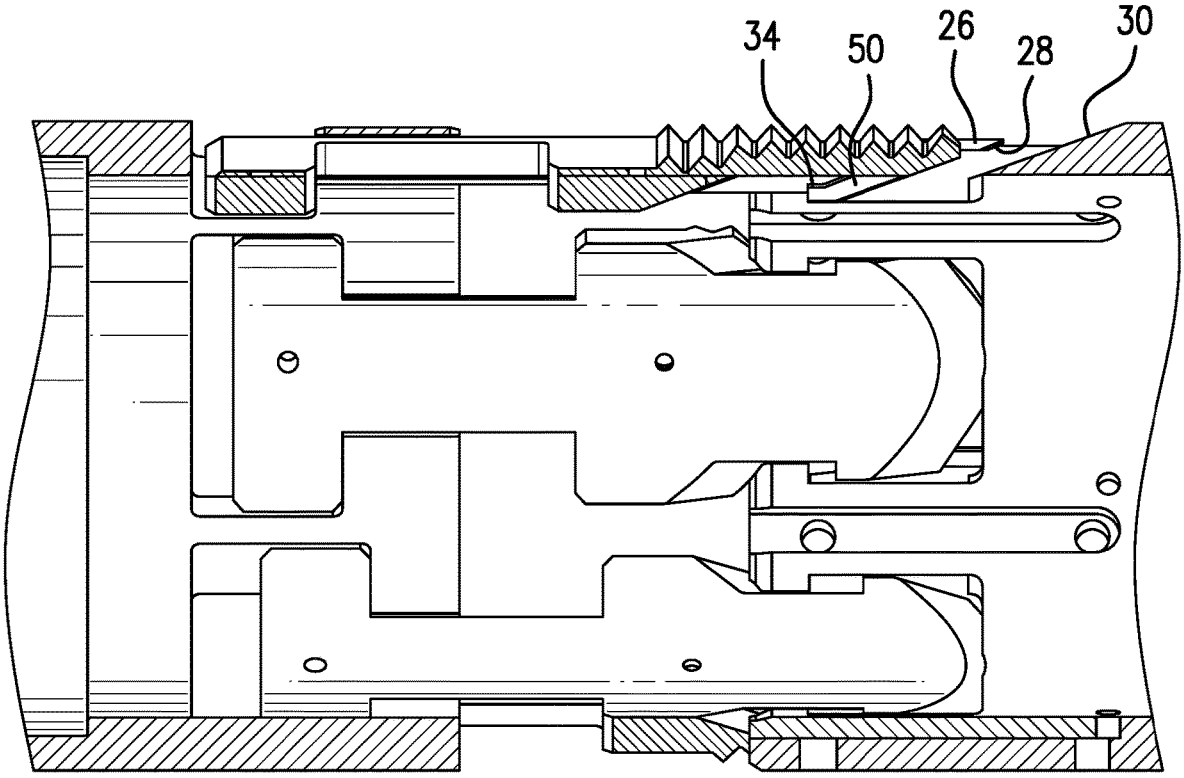
FIG. 5 is a cross sectional view of the system illustrated in FIG. 1.
Figure 8:
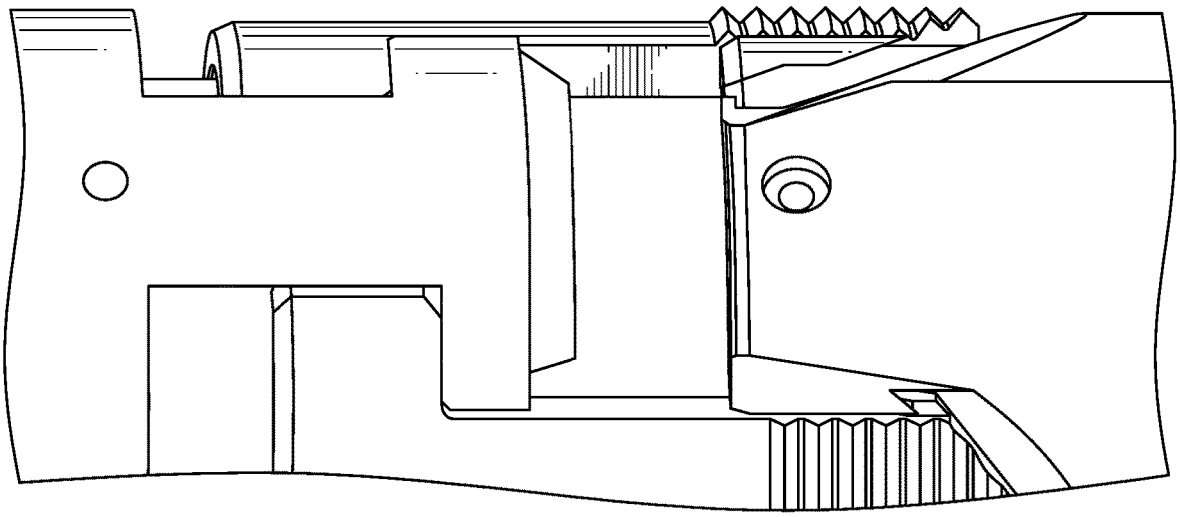
FIG. 8 is a partially transparent view of a slip engaged in the alternate track subsystem illustrated in FIG. 7.
Figure 9:
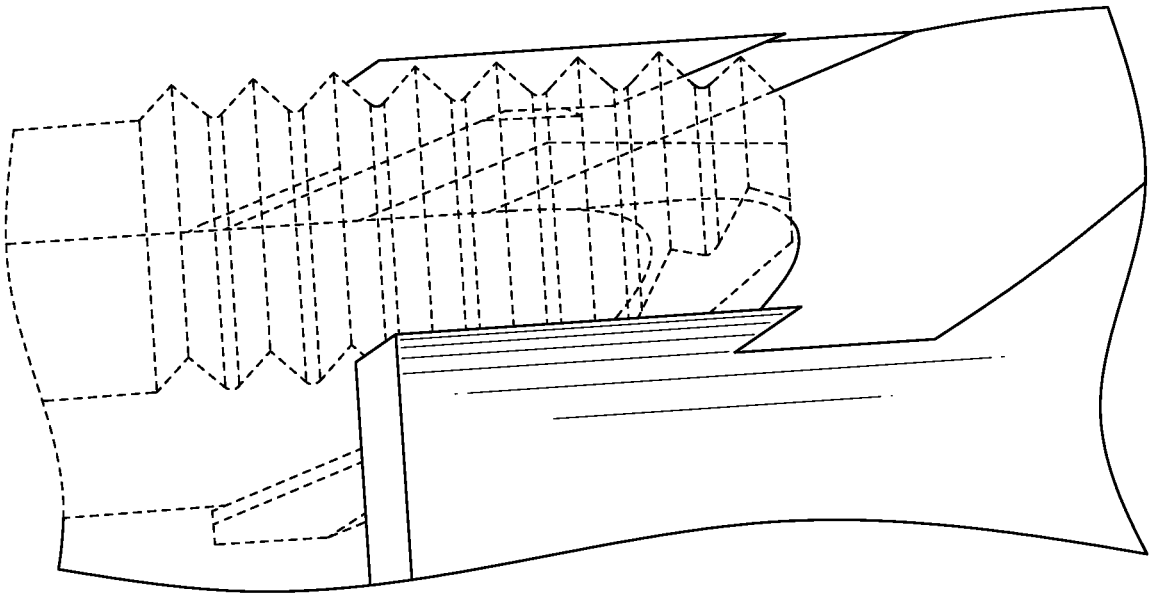
FIG. 9 is a side view of a slip system that uses the alternate track subsystem.

Referring to FIG. 5, interaction of the components of the system 10 can be appreciated. In FIG. 5, the system 10 is illustrated in a released position where it may be appreciated that the stop mating surface 52 is in contact with the stop 34 and hence a tensile load imposed by the slip ring 16 is transmitted through the slips 12 to the cone 14 thereby enabling first the pull down of the slips and then the repositioning of the entire system 10. It should also be noted that retract surface 54 has ridden under buttress 26 in the decouple recess 32. The ability of the slips 12 to have retract faces 54 decouple with track face 28 is what prevents the slip from being pulled into contact with a mandrel. The mandrel is not shown in this embodiment so that components are visible but will be understood to be immediately radially inwardly disposed of the system 10. Further, the mandrel is shown in the embodiment discussed in FIGS. 7-9 and would be in the same place for this embodiment. The slips 12, once decoupled from the track face 28, can move longitudinally of the system in parallel to a longitudinal axis of the system 10. All track systems of the prior art fail to provide such longitudinal freedom of movement and hence are contraindicated for a timed-release slip ring 16. Because of this ability of the disclosed system 10 to move longitudinally of the system in parallel to a longitudinal axis of the system 10, timed release is enabled where it could not be in the prior art. The disclosed system hence allows for a tensile load to be applied to a first one or more of the plurality of slips 12 while not applying that load to others of the plurality of slips 12. The first one or more may thus be unset and moved longitudinally so that a second one or more of the plurality of slips 12 may be loaded with a tensile load and unset as well. If more groups of the plurality of slips 12 are also to be moved then the sequence may continue with each groups of unset slips moving longitudinally of the system in parallel with the longitudinal axis until al slips of the plurality of slips 12 are unset and the system is ready for movement. For example, in an embodiment five slips comprise the plurality of slips 12 and they are released in the sequence of two slips, then two more slips and then one slip. Other combinations are also contemplated.

Figure 6:
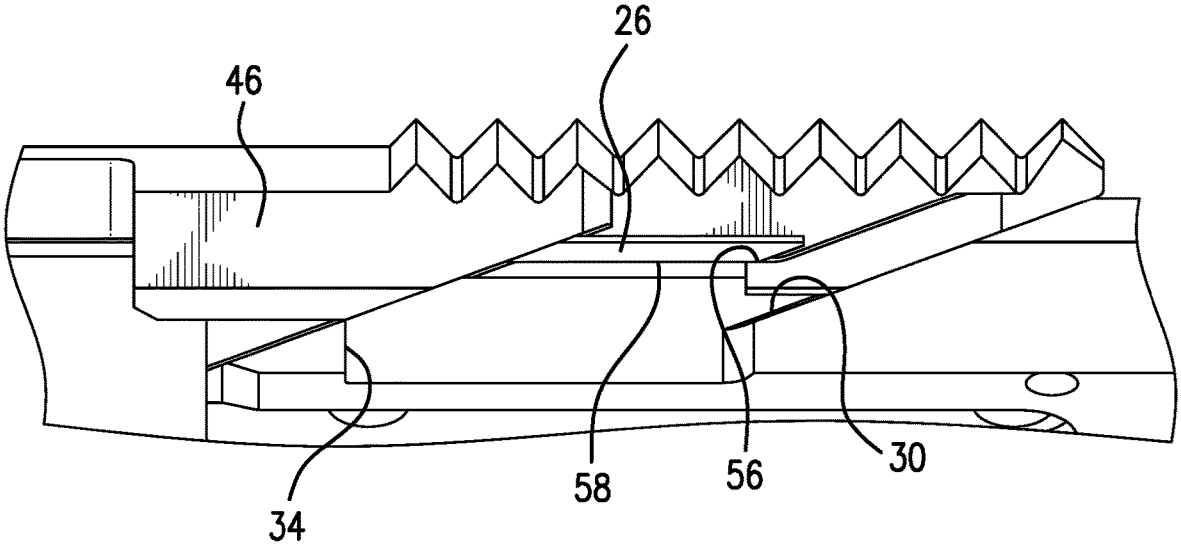
FIG. 6 is an enlarged view of a portion of FIG. 5.

Referring to FIG. 6, retention of the individual slips of the plurality of slips 12 is illustrated. One slip 40 of the plurality of slips 12 in the fully deployed position of the slip 46 cannot be deployed further regardless of biting into a casing or other radially outward structure because the slip 40 is physically restrained. The slip hence cannot "fall out" of the cone 14 (in situations for example, where the radially outwardly positioned structure is out of round and the slip cannot make contact therewith) because the catch surface 56 contacts an underside 58 of the buttress 26.

Figure 7:
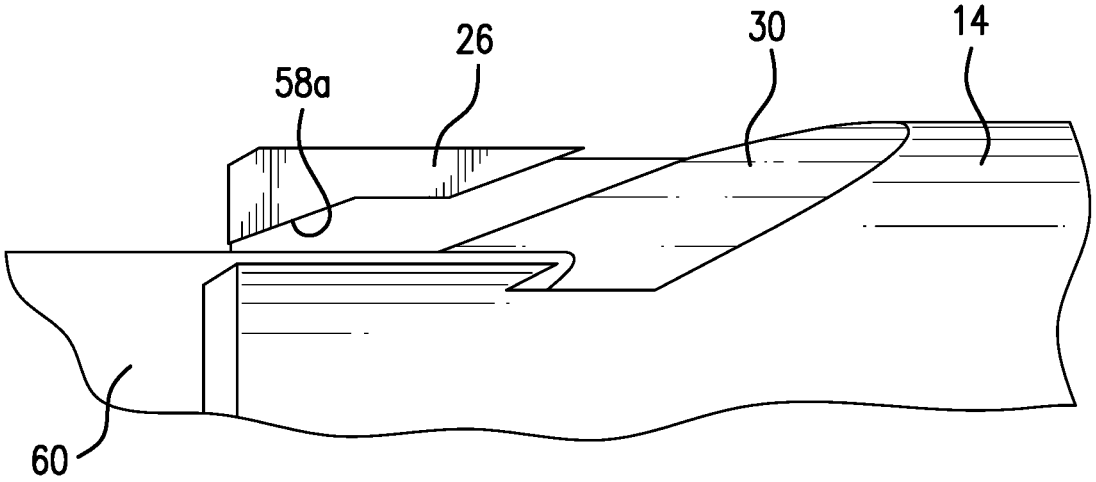
FIG. 7 is a perspective view of an alternate track subsystem in the cone.

Referring to FIG. 7, another embodiment of the track subsystem 20 is illustrated. In this embodiment, rather than configuring the buttress 26 with the underside 58 ending as an opening as in the first embodiment, the underside 58*a* continues at an angle toward the mandrel 60. The stop 34 is not needed in this embodiment since the underside 58*a* will effectively trap the slip 40 against the mandrel to prevent its movement under tensile load past the point of trap. Hence, tensile load imparted by the slip ring 16 is transmitted through the slips 12 to the cone 14 just as in the previous embodiment. This functionality can be seen in FIGS. 8 and 9.

Figure 10:
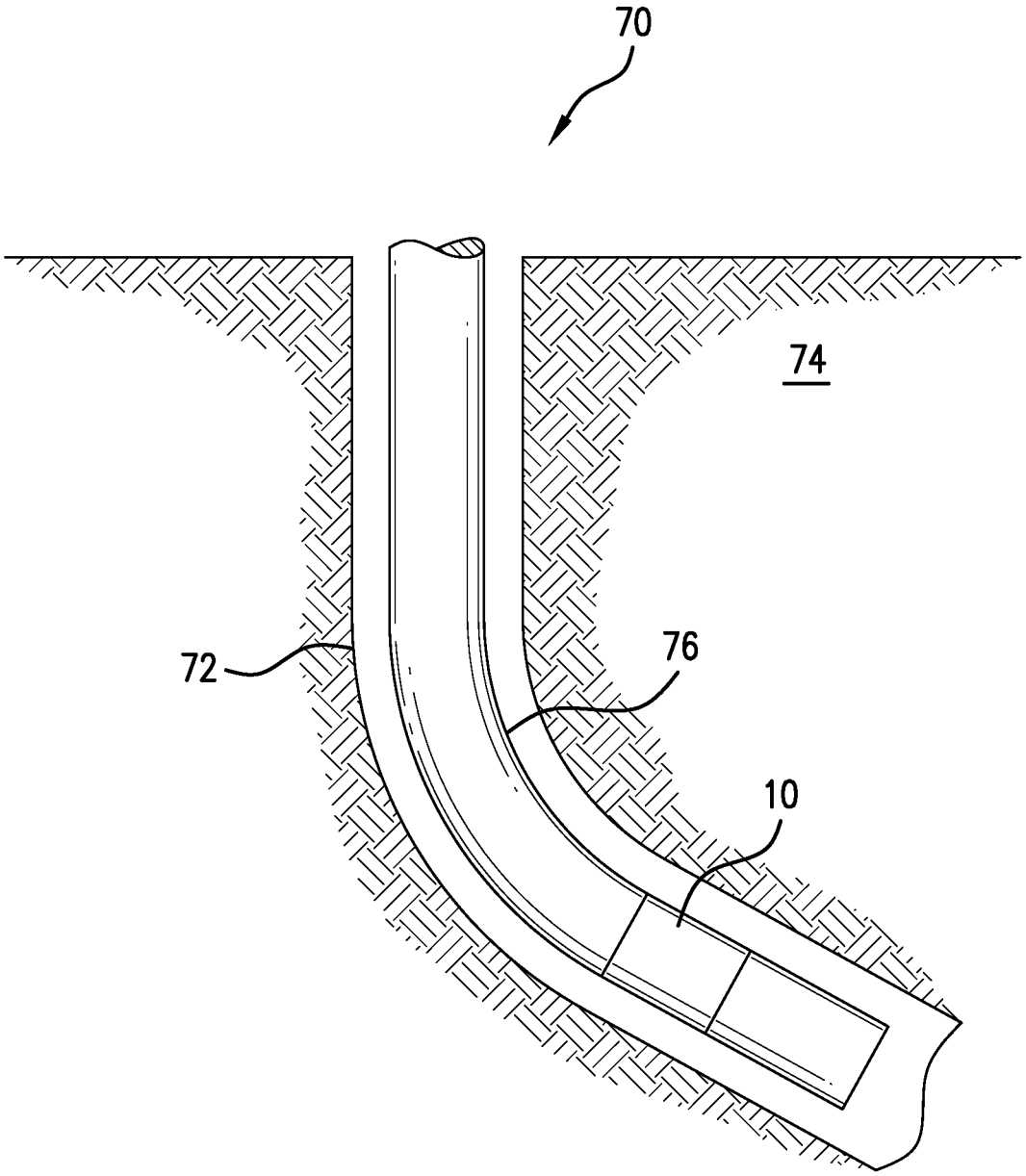
FIG. 10 is a schematic view of a borehole system including the slip system disclosed herein.

Referring to FIG. 10, a borehole system 70 is illustrated. System 70 includes a borehole 72 in a subsurface formation 74. A string 76 is disposed in the borehole 72. A slip systems 10 is disposed within or as a part of the string 76.

Set forth below are some embodiments of the foregoing disclosure:

Embodiment 1: A timed-release slip system including a plurality of slips each having a lateral tongue, a cone having a track subsystem, the track subsystem configured to retain the plurality of slips during running and setting while allowing longitudinal motion of the slip in parallel to a longitudinal axis of the cone while being retrieved, a slip ring configured to pull one or more of the plurality of slips before a different one or more of the plurality of slips.

Embodiment 2: The system as in any prior embodiment, wherein the track subsystem includes a plurality of slip separators and a slip way between adjacent slip separators.

Embodiment 3: The system as in any prior embodiment, further including a buttress extending in a circumferential direction from a separator of the plurality of separators.

Embodiment 4: The system as in any prior embodiment, wherein the buttress includes a track face in parallel with a cone face.

Embodiment 5: The system as in any prior embodiment, wherein the buttress includes a decouple recess.

Embodiment 6: The system as in any prior embodiment, wherein the buttress contacts the lateral tongue of one slip of the plurality of slips.

Embodiment 7: The system as in any prior embodiment, wherein the track subsystem includes a stop that interacts with one or more of the plurality of slips to transfer a tensile load placed upon the one of the plurality of slips to the cone.

Embodiment 8: The system as in any prior embodiment, wherein the lateral tongue includes a stop mating surface.

Embodiment 9: The system as in any prior embodiment, wherein the lateral tongue includes a catch surface dimensioned and positioned to prevent an associated one of the plurality of slips from escaping the track subsystem.

Embodiment 10: The system as in any prior embodiment, wherein the slip ring includes windows receptive to individual tails of the plurality of slips, the windows configured to impart a tensile load to individual ones of the plurality of slips in a pattern of two slips, then two other slips and then one slip during release of the system.

Embodiment 11: A method for setting and releasing a slip system, including driving a plurality of slips into a cone having a track subsystem configured to retain the plurality of slips during running and setting against a radially outwardly positioned structure, applying a tensile load to a first one or more of the plurality of slips while not applying tensile load to a second one or more of the plurality of slips, allowing longitudinal motion of the first one or more of the plurality of slips in parallel to a longitudinal axis of the cone while being released.

Embodiment 12: The method as in any prior embodiment, further including causing a stop mating surface to make contact with a stop of the track subsystem.

Embodiment 13: The method as in any prior embodiment, wherein the applying the load is through a timed slip ring.

Embodiment 14: The method as in any prior embodiment, further including applying a tensile load to the second one or more of the plurality of slips.

Embodiment 15: The method as in any prior embodiment, further including tripping the slip system through the radially outwardly structure.

Embodiment 16: A downhole tool including a mandrel, a plurality of slips each having a lateral tongue disposed on the mandrel, a cone having a track subsystem disposed on the mandrel, the track subsystem configured to retain the plurality of slips during running and setting while allowing longitudinal motion of the slip in parallel to a longitudinal axis of the cone while being retrieved, a slip ring disposed on the mandrel and configured to apply tensile load to one or more of the plurality of slips before a different one or more of the plurality of slips.

Embodiment 17: A borehole system including a borehole in a subsurface formation, a string in the borehole, and a slip system as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A timed-release slip system comprising: a plurality of slips each having a lateral tongue; a cone having a track subsystem including a track face extending along the cone, the track face having an angle relative to a longitudinal axis of the cone, the track subsystem further including a decouple recess extending from the track face in parallel with the longitudinal axis of the cone, the track subsystem configured to retain the plurality of slips during the running and setting, by engaging the lateral tongue, the decouple recess configured to allow longitudinal motion of the lateral tongue solely in parallel to a-the longitudinal axis of the cone while being retrieved; and a slip ring configured to pull one or more of the plurality of slips before a different one or more of the plurality of slips.

2. The system as claimed in claim 1, wherein the track subsystem includes a plurality of slip separators and a slip way between adjacent slip separators.

3. The system as claimed in claim 2, further including a buttress extending in a circumferential direction from a separator of the plurality of separators.

4. The system as claimed in claim 3, wherein the buttress includes a track face in parallel with a cone face.

5. The system as claimed in claim 3, wherein the buttress includes a decouple recess.

6. The system as claimed in claim 3, wherein the buttress contacts the lateral tongue of one slip of the plurality of slips.

7. The system as claimed in claim 1, wherein the track subsystem includes a stop that interacts with one or more of the plurality of slips to transfer a tensile load placed upon the one of the plurality of slips to the cone.

8. The system as claimed in claim 7, wherein the lateral tongue includes a stop mating surface.

9. The system as claimed in claim 1, wherein the lateral tongue includes a catch surface dimensioned and positioned to prevent an associated one of the plurality of slips from escaping the track subsystem.

10. The system as claimed in claim 1, wherein the slip ring includes windows receptive to individual tails of the plurality of slips, the windows configured to impart a tensile load to individual ones of the plurality of slips in a pattern of two slips, then two other slips and then one slip during release of the system.

11. A method for setting and releasing a slip system, comprising:

driving a plurality of slips having a lateral tongue into a cone having a track subsystem including a track face extending along the cone, the track face having a angle relative to a longitudinal axis of the cone, the track subsystem further including a decouple recess extending from the track face in parallel with the longitudinal axis of the cone within which the lateral tongue is disposed, the track subsystem configured to retain the plurality of slips during running and setting against a radially outwardly positioned structure;

applying a tensile load to a first one or more of the plurality of slips while not applying tensile load to a second one or more of the plurality of slips;

longitudinally moving the lateral tongue of the first one or more of the plurality of slips in parallel to a longitudinal axis of the cone in the decouple recess of the track subsystem while being released.

12. The method as claimed in claim 11, further including causing a stop mating surface to make contact with a stop of the track subsystem.

13. The method as claimed in claim 11, wherein the applying the load is through a timed slip ring.

14. The method as claimed in claim 11, further including applying a tensile load to the second one or more of the plurality of slips.

15. The method as claimed in claim 11, further including tripping the slip system through the radially outwardly structure.

16. A downhole tool comprising: a mandrel; a plurality of slips each having a lateral tongue disposed on the mandrel; a cone having a track subsystem including a track face extending along the cone the track face having an angle relative to a longitudinal axis of the cone, the track subsystem further including a decouple recess extending from the track face in parallel with the longitudinal axis of the cone, within which the lateral tongue is disposed on the mandrel, the track subsystem configured to retain the plurality of slips during running and setting, and configured to allow longitudinal motion of the lateral tongue in parallel to a longitudinal axis of the cone while being retrieved; a slip ring disposed on the mandrel and configured to apply tensile load to one or more of the plurality of slips before a different one or more of the plurality of slips.

17. A borehole system comprising:

a borehole in a subsurface formation;

a string in the borehole; and a slip system as claimed in claim 1, disposed within or as a part of the string.

* * * * *